United States Patent [19]

Wilson

[11] 4,043,014

[45] Aug. 23, 1977

[54] METHOD OF MAKING A WASTE FLUE HEAT RECOVERY DEVICE

[76] Inventor: John C. Wilson, 44 Eagle St., Greenville, Pa. 16125

[21] Appl. No.: 630,796

[22] Filed: Nov. 11, 1975

[51] Int. Cl.[2] ..... F22D 1/02; B21D 53/02

[52] U.S. Cl. ..... 29/157.4; 122/20 B

[58] Field of Search ..... 122/20 B, 412, 421, 122/250 R; 29/157.4, 157.3 A, 157.1 AH, 157.3 C, 157.5

[56] References Cited

U.S. PATENT DOCUMENTS

| | | | |
|---|---|---|---|
| 685,835 | 11/1901 | Groh | 122/20 |
| 1,065,837 | 6/1913 | Reichard | 122/20 |
| 1,934,021 | 11/1933 | Wafter | 29/157.4 |
| 2,143,287 | 1/1939 | Smith | 122/20 |
| 2,252,046 | 8/1941 | Steele | 122/20 |
| 3,083,447 | 4/1963 | Andersen et al. | 29/157.3 |
| 3,566,502 | 3/1971 | Pasqualini | 29/157.3 |
| 3,639,963 | 2/1972 | Maher | 29/157.3 |

*Primary Examiner*—Kenneth W. Sprague

[57] ABSTRACT

A novel and easy method of construction and assembly which enables a tubular coil to be inserted in an open flue pipe so the flue pipe can be joined; water passing through the coil will recover waste flue heat from furnaces and boilers.

2 Claims, 5 Drawing Figures

METHOD OF MAKING A WASTE FLUE HEAT RECOVERY DEVICE

FIELD OF THE INVENTION

This invention relates to a method of construction and assembly of a tubular coil in a flue pipe and the partial recovery of the waste heat which goes into the flue. The object is to recover some of this heat by passing water through a coil which is inside the flue pipe. The pre-heated water to flow to the hot water tank instead of cold water which will give better heat utilization. This invention will reduce the cost of a unit capable of recovering the waste flue heat and can be adapted to existing furnaces and boilers.

DESCRIPTION OF THE PRIOR ART

Many furnaces, stoves and boilers have been proposed in the past which incorporated a coil within the furnace; these units have utilized various means of controlling the heat within the furnace which would result in very expensive construction to achieve hot water or pre-heated water; as a result these units have not had ready acceptance.

SUMMARY OF THE INVENTION

The present invention will enable a coil to be enveloped in a flue pipe with a minimum of labor. It covers how to manufacture the coil by having the ends of said coil extending in the same direction and at right angles to the coil; the coil is then capable of being enveloped in a flue pipe blank which has a pair of longitudinally aligned holes. The application will permit waste flue heat recovery with water passing trhough the coil, said heated water to flow to units that utilize water as a means of heat transfer.

DESCRIPTION OF THE PREFERRED EMBODIMENTS

Figure 1A:
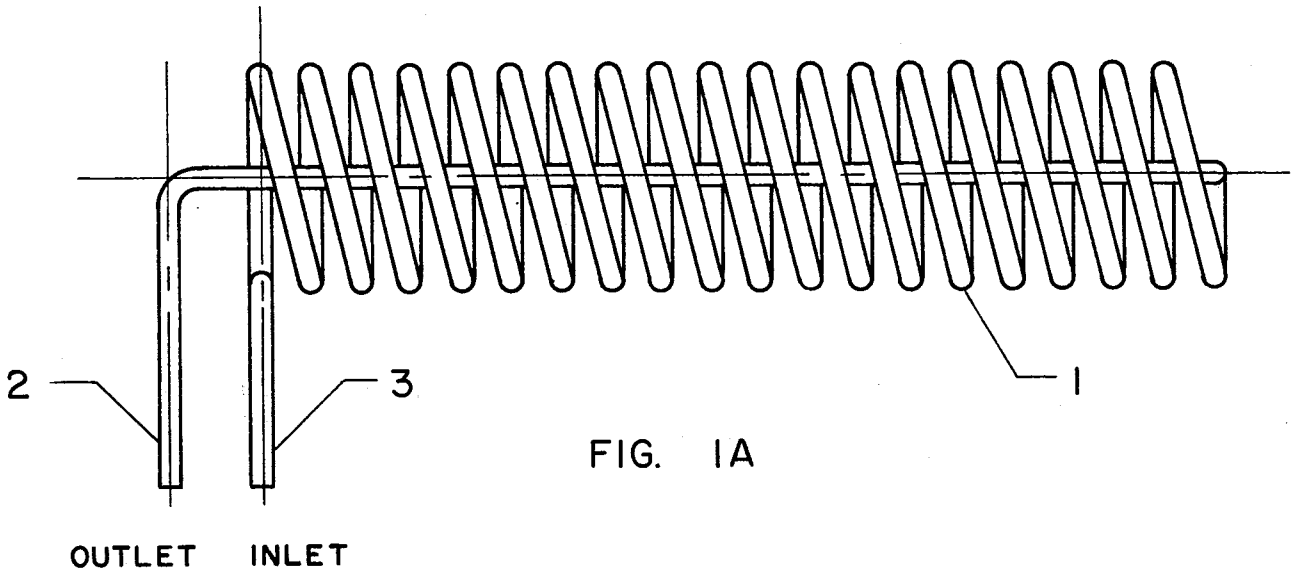
FIG. 1A shows the coil with a leg up the middle with the ends parallel to each other.
Figure 1B:
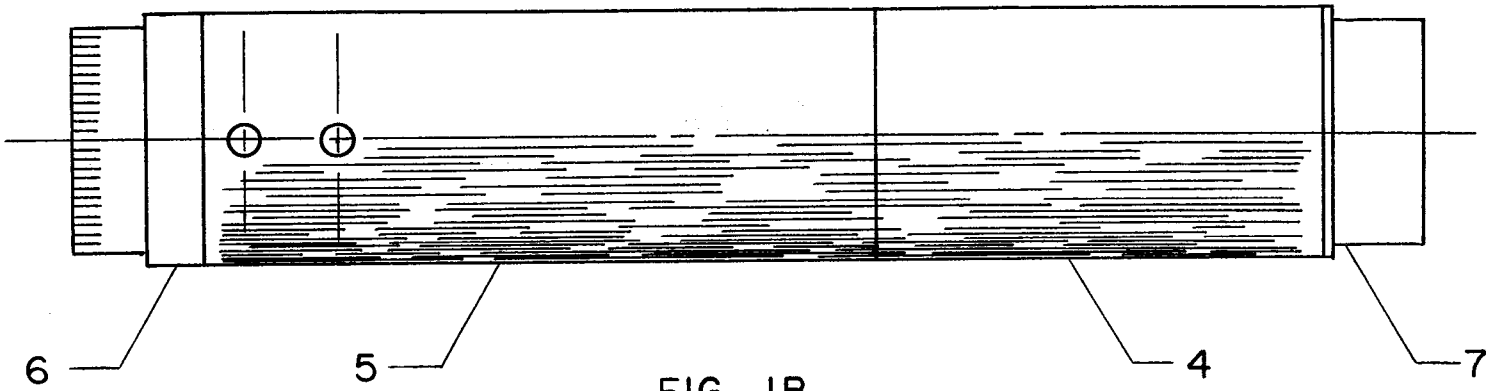
FIG. 1B shows the coil with the flue pipe joined around the coil.
Figure 2A:
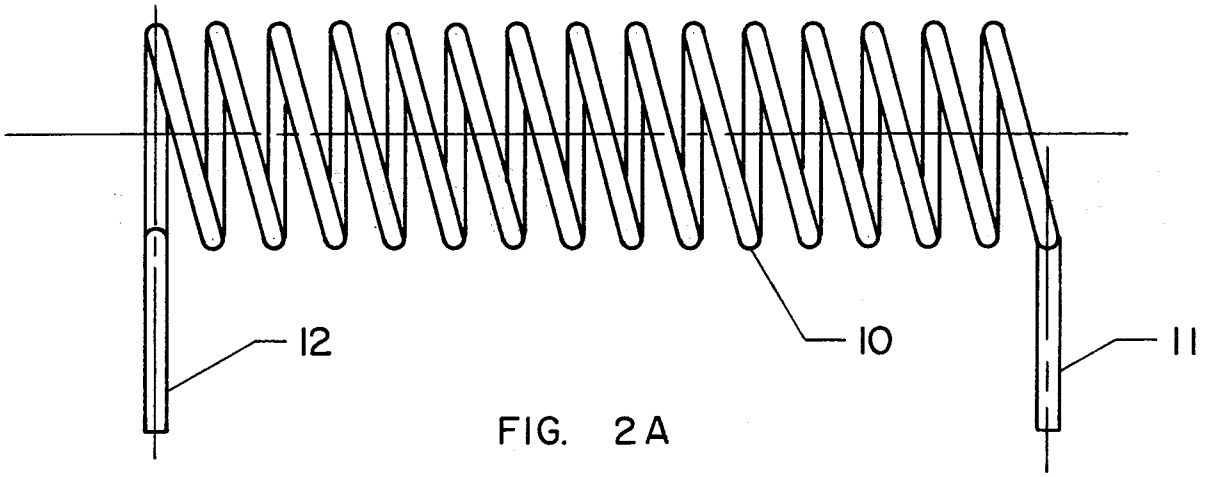
FIG. 2A shows a coil with inlet and outlet at opposite ends, with the inlet and outlet parallel and facing in the same direction.
Figure 2B:
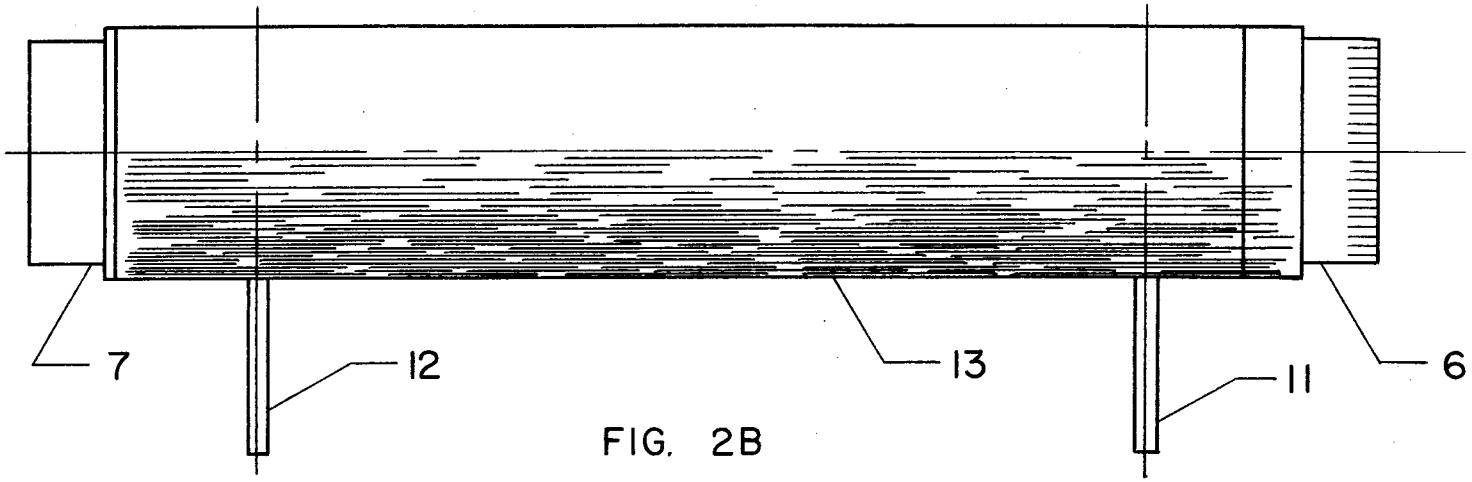
FIG. 2B shows the coil inside the flue pipe.

The coil in FIG. 1A has been constructed so end 2 and 3 are close together, the ends 2 and 3 face in the same direction and are parallel; this method of construction of the coil 1 will permit two or more flue pipes to be assembled around the coil. In FIG. 2A flue pipe 5 has matching pre-drilled holes to correspond to the coil ends 2 and 3 in FIG. 1A. The coil 1 is placed inside the open flue pipe 5 in FIG. 2A with the ends 2 and 3 going through the pre-drilled holes in flue pipe 5 in FIG. 2A.

The flue pipe 5 is then joined forming the first section 5; the second section of the flue pipe 4 is joined and slids into place meshing with flue pipe section 5. End caps 6 and 7 are installed to the flue pipe sections 4 and 5; the end caps 6 and 7 are matched to the existing flue pipes.

The coil in FIG. 2A has been constructed so end 12 and 11 are at opposite ends of the coil 10. The ends 12 and 11 face is the same direction. In the assembly pre-drilled holes in the open flue pipe 13 permit the ends 12 and 11 of the coil 10 to be inserted into the open flue pipe 13, then flue pipe 13 can be joined to envelope the coil 10. End caps 6 and 7 are installed to the flue pipe 13 to match existing flue pipes which is shown on FIG. 3.

Figure 3:
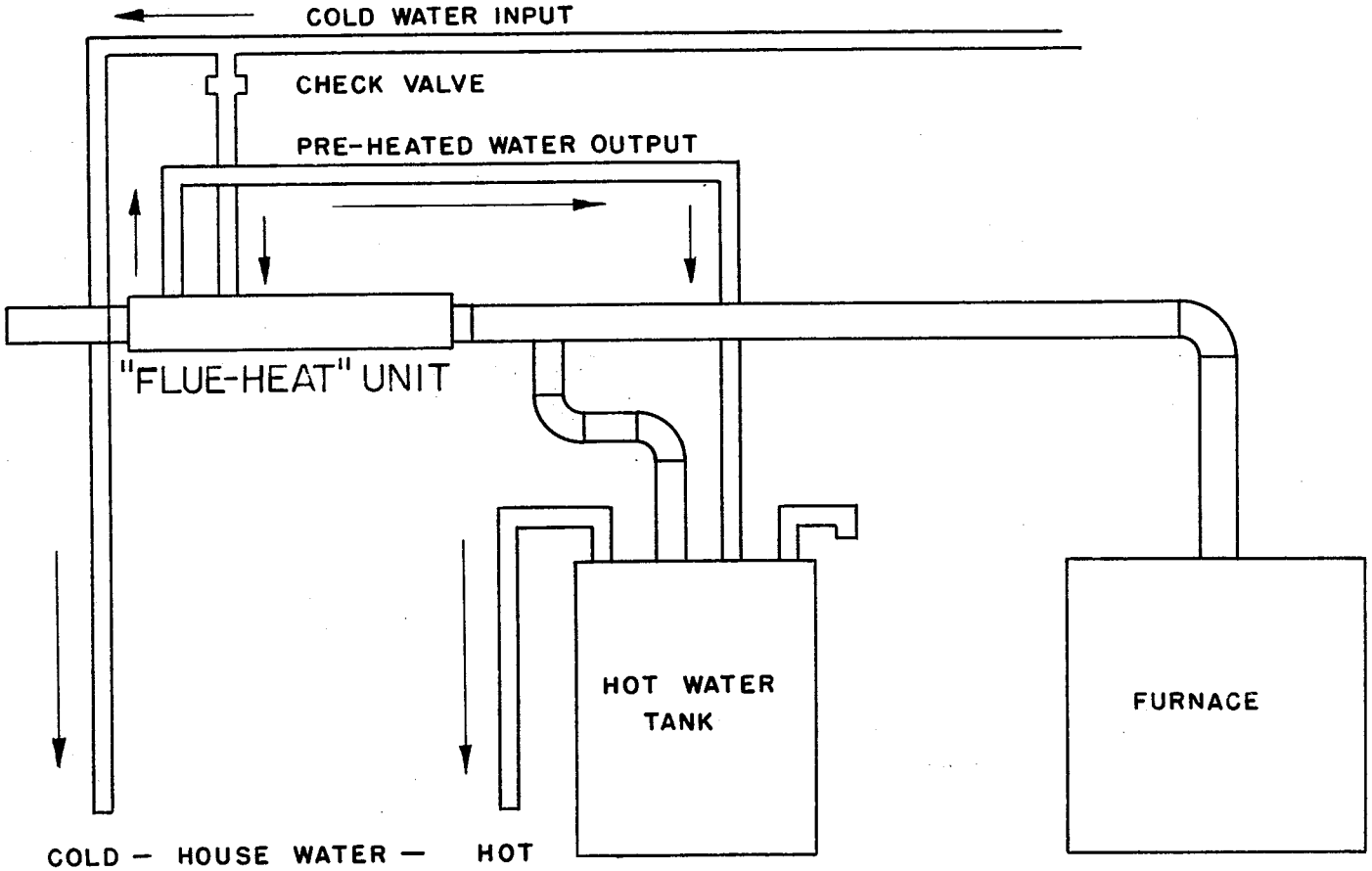
FIG. 3 is a schematic of the unit connected into an existing heating system.

FIG. 3 is a scheme to illustrate the flow of the water through the system to achieve the heat recovery. The water flows from the water supply to a check valve which prevents the heated water from backing up into the water system, then the water flows to the coil which is inside the flue pipe, the water passes through the coil and absorbs the wasted heat in the flue pipe; the waste heat being generated by the use of the furnace and the hot water heating tank; the pre-heated water in the coil then feeds to the hot water tank instead of cold water.

I claim:

1. A method of manufacturing a heat recovery unit which consists of providing a flue pipe blank, forming a pair of Longitudinally aligned holes which are located at one end of said blank, forming a water heating coil by forming a plurality of coil turns, forming one end of the coil with a straight portion of tubing extending therefrom, forming the other end of the coil with a second straight portion that extends through the middle of the coil and then bending the second straight portion at the right angles to extend parallel to the first straight portion, inserting the ends of said portions through said aligned holes, wrapping the flue pipe blank around the coil and joining the edges of the flue pipe blank together.

2. A method of manufacturing a heat recovery unit which consists of providing a flue pipe blank, forming a pair of longitudinally aligned holes which are located at opposite ends of said flue pipe blank, forming a water heating coil by forming a plurality of coil turns, forming one end of the coil with a straight portion of tubing extending therefrom, forming the other end of the coil with a second straight section of tubing which extends from the coil at right angles and in the same direction and parallel to the first straight section portion, inserting the ends of said portions through the aligned holes at opposite ends of said flue pipe blank, wrapping the flue pipe blank around the coil and joining the edges of the flue pipe blank together.

* * * * *